US011766767B2

(12) United States Patent
Hsieh

(10) Patent No.: US 11,766,767 B2
(45) Date of Patent: Sep. 26, 2023

(54) ANTI-ROLLING SOCKET

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 51 days.

(21) Appl. No.: 17/654,086

(22) Filed: Mar. 9, 2022

(65) Prior Publication Data

US 2022/0324083 A1 Oct. 13, 2022

(30) Foreign Application Priority Data

Apr. 8, 2021 (TW) ..... 110112780

(51) Int. Cl.
*B25B 13/06* (2006.01)
*B25B 23/00* (2006.01)

(52) U.S. Cl.
CPC ..... *B25B 13/06* (2013.01); *B25B 23/0007* (2013.01)

(58) Field of Classification Search
CPC ..... B25B 13/06; B25B 23/0007
USPC ..... 81/184
See application file for complete search history.

(56) References Cited

U.S. PATENT DOCUMENTS 5,287,776 A * 2/1994 Williams ..... B25B 27/0035 81/177.85
5,365,807 A * 11/1994 Darrah ..... B25B 23/0035 81/177.85
7,127,969 B2 * 10/2006 Hsieh ..... B25B 13/06 81/120
9,156,141 B2 * 10/2015 Chang ..... B25B 13/06
10,780,557 B2 * 9/2020 Wolzak ..... B25B 13/107
2005/0011319 A1 * 1/2005 Cho ..... B25B 13/06 81/177.85
2012/0031242 A1 * 2/2012 Li ..... B25B 13/06 81/184

* cited by examiner

*Primary Examiner* — Hadi Shakeri
(74) *Attorney, Agent, or Firm* — Wang Law Firm, Inc.

(57) ABSTRACT

An anti-rolling socket includes a socket body, a groove, a through hole, and a stopper. The socket body has an inner peripheral surface and an outer peripheral surface. The groove is disposed in, and along the circumference of, the inner peripheral surface. The through hole is disposed between the inner peripheral surface and the outer peripheral surface and communicates with the groove. The stopper includes a stop ring and a stop section. The stop ring is fitted in the groove. The stop section is connected to the stop ring. The stop section projects from the through hole and protrudes from the outer peripheral surface. The stop section can abut against a flat surface to prevent the socket body from rolling on the flat surface.

10 Claims, 7 Drawing Sheets

20

ANTI-ROLLING SOCKET

BACKGROUND OF THE INVENTION

1. Technical Field

The present invention relates to a part of a tool and more particularly to an anti-rolling socket for use with a hand tool.

2. Description of Related Art

Recently, the market has been supplied with a variety of sockets that are designed to facilitate hand tool operation, and most of these and other conventional sockets are cylindrical. When a hand tool is inserted into such a socket and placed on a flat surface along with the socket, the surface contour of the socket makes the socket prone to rolling on the flat surface. When intending to use the socket again, therefore, the user may have to pick up the socket from a farther place than where the socket was originally placed; in other words, the picking process could be time-consuming and hence lower work efficiency. If the flat surface is inclined or if the socket has been inadvertently kicked by the user, the socket may have rolled to a hidden corner or a place beneath a machine and in that case will be difficult to find. Should anyone step on the stray socket, the person could be at risk or hindered from doing their work.

In light of the aforesaid drawback of the conventional sockets, it has been a goal of research and development in the related industries to devise sockets that will not roll on a flat surface. Such sockets are also what the general public wish for.

BRIEF SUMMARY OF THE INVENTION

One objective of the present invention is to provide an anti-rolling socket in which a stopper is disposed in the socket body to not only form a structure for engaging with a hand tool, but also provide a stop section protruding from the outer peripheral surface of the socket body to prevent the socket from rolling on a flat surface.

According to an embodiment of the present invention, an anti-rolling socket includes a socket body, at least one groove, at least one through hole, and at least one stopper. The socket body has an inner peripheral surface and an outer peripheral surface. The at least one groove is disposed in, and along the circumference of, the inner peripheral surface. The at least one through hole is disposed between the inner peripheral surface and the outer peripheral surface and communicates with the at least one groove. The at least one stopper includes a stop ring and a stop section, with the stop ring fitted in the at least one groove, and the at least one stop section connected to the stop ring, projecting from the at least one through hole, and protruding from the outer peripheral surface.

The anti-rolling socket of the present invention is so designed that the socket body is provided with the through hole, and that the stop section projects from the through hole, protrudes from the outer peripheral surface of the socket body, and can therefore abut against a flat surface to prevent the socket body from rolling on the flat surface.

According to another embodiment of the present invention, the number of the at least one groove is two, and the number of the at least one stopper is two. The two stoppers are disposed in the two grooves respectively.

According to another embodiment of the present invention, the number of the at least one groove is two, the number of the at least one stopper is one, and the anti-rolling socket further includes a C-clip. The stopper is disposed in one of the grooves, and the C-clip is fitted in the other groove.

According to another embodiment of the present invention, the number of the at least one through hole is plural, and the number of the at least one stop section is plural. The stop sections project from the through holes respectively.

According to another embodiment of the present invention, the stop ring has a wavy shape.

According to another embodiment of the present invention, the stop ring has a polygonal cross section.

According to another embodiment of the present invention, the stop ring is a closed stop ring.

According to another embodiment of the present invention, the stop ring is an open stop ring.

According to another embodiment of the present invention, the number of the at least one stop section is two, and the two stop sections are located at two ends of the stop ring respectively.

According to another embodiment of the present invention, the stop ring has two ends, and the stop ring surrounds a central axis of the socket body in such a way that the two ends define a reflex central angle $\theta$ satisfying the condition: $270° \leq \theta \leq 360°$.

BRIEF DESCRIPTION OF THE SEVERAL VIEWS OF THE DRAWINGS

The above and other objectives, as well as the features, advantages, and following embodiments, of the present invention can be better understood by referring to the accompanying drawings, in which.

DETAILED DESCRIPTION OF THE INVENTION

Figure 1:
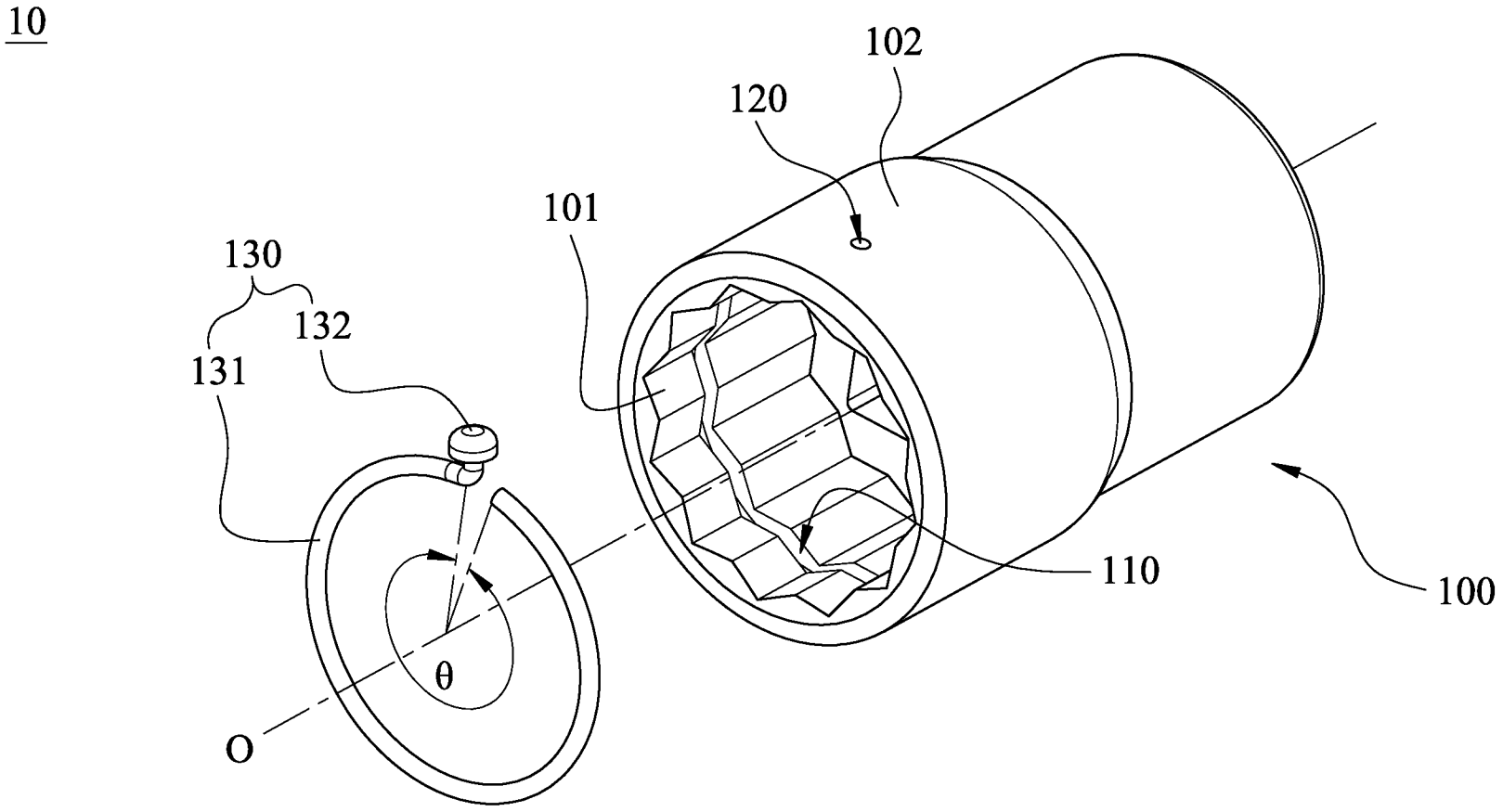
FIG. 1 is an exploded perspective view of the anti-rolling socket according to the first embodiment of the present invention.

A number of embodiments of the present invention are described below with reference to the accompanying drawings. The following description will include many practical details in order to be clear and specific. The reader, however, should understand that those practical details are not intended to be restrictive of the scope of the invention; in other words, the practical details are not essential to some embodiments of the invention. Besides, for the sake of simplicity of the drawings, some conventional or commonly used structures and elements are drawn only schematically in the drawings, and repeated elements may be indicated by the same reference numeral or similar reference numerals.

Please refer to FIG. 1 for an exploded perspective view of the anti-rolling socket 10 according to the first embodiment of the present invention. As shown in FIG. 1, the anti-rolling socket 10 includes a socket body 100, at least one groove 110, at least one through hole 120, and at least one stopper 130. The socket body 100 has an inner peripheral surface 101 and an outer peripheral surface 102. The groove 110 is disposed in, and along the circumference of, the inner peripheral surface 101. The through hole 120 is disposed between the inner peripheral surface 101 and the outer peripheral surface 102 and communicates with the groove 110. The stopper 130 includes a stop ring 131 and at least one stop section 132. The stop ring 131 is fitted in the groove 110, and the stop section 132 is connected to the stop ring 131. Moreover, the stop section 132 projects from the through hole 120 and protrudes from the outer peripheral surface 102.

More specifically, the stop ring 131 is an open stop ring and has two ends. The stop ring 131 surrounds the central axis O of the socket body 100 in such a way that the two ends define a reflex central angle θ satisfying the condition: $270° \leq \theta \leq 360°$. This configuration helps increase the smoothness of operation of fitting the stop ring 131 into the groove 110. The stop ring 131 is made of an elastic material such as rubber, plastic, or metal; the present invention has no limitation in this regard. In the first embodiment, the stop ring 131 is made of metal in order to have high wear resistance.

The anti-rolling socket 10 of the present invention is so configured that an engaging structure is formed by disposing the stop ring 131 of the stopper 130 in the groove 110. When a hand tool (not shown) is inserted into the socket body 100, the stop ring 131 is pressed by the hand tool such that the position of the hand tool is limited by engagement between the hand tool and the stop ring 131. One special feature of this embodiment is that the stop section 132 connected to the stop ring 131 extends through the through hole 120 and is exposed from the outer peripheral surface 102 of the socket body 100. When the anti-rolling socket 10 together with the hand tool inserted therein is placed horizontally on a flat surface, the hand tool, the outer peripheral surface 102 of the socket body 100, and the stop section 132 form three contact points on the flat surface. These contact points prevent the hand tool and the anti-rolling socket 10 from rolling. Thus, by performing such simple machining operations as connecting the stop section 132 to the stop ring 131 to form the stopper 130, and drilling the through hole 120 in the socket body 100 to allow the stop section 132 to protrude from the outer peripheral surface 102 by way of the through hole 120, the intended effect of preventing the socket body 100 from rolling is achieved, and the economic benefit and competitiveness of the end product are therefore enhanced. The aforesaid flat surface may be a floor, a tabletop, or any other surfaces where the anti-rolling socket 10 can be placed.

Figure 2:
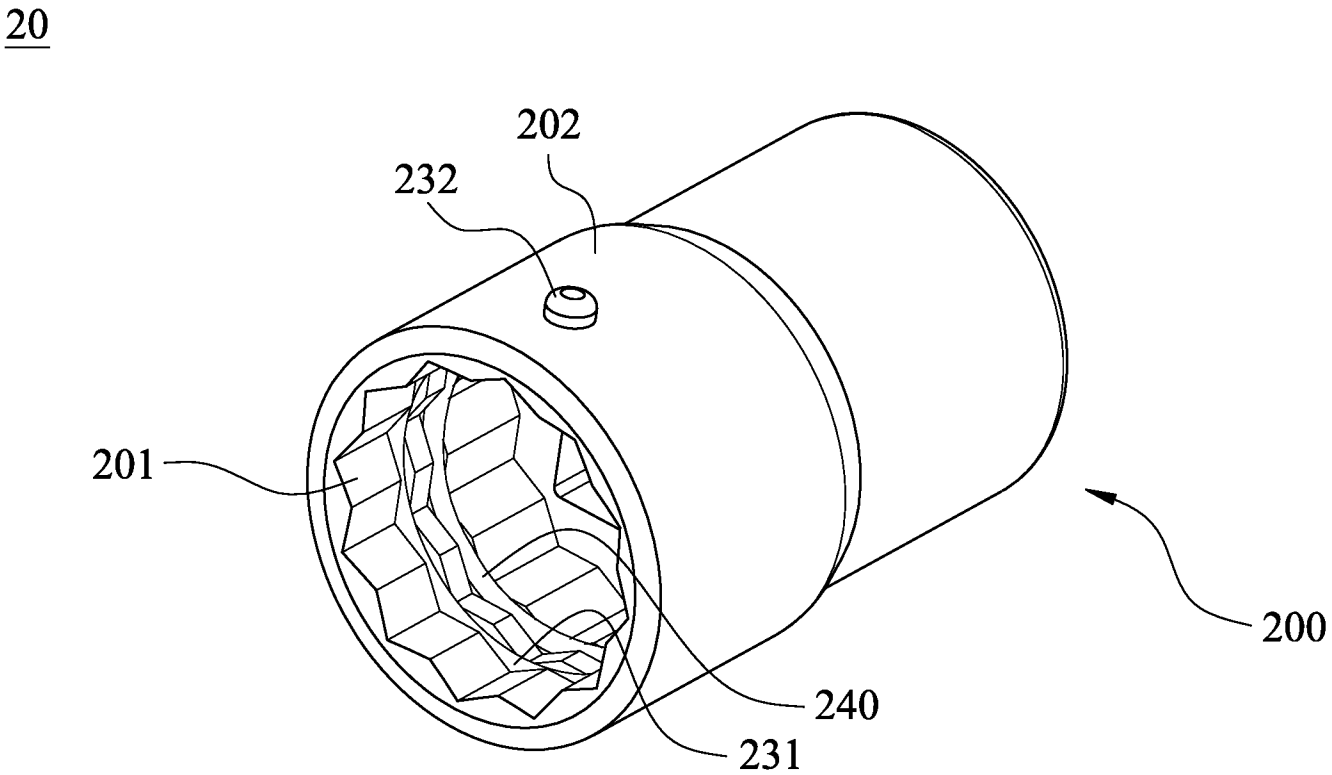
FIG. 2 is a perspective view of the anti-rolling socket according to the second embodiment of the invention.
Figure 3:
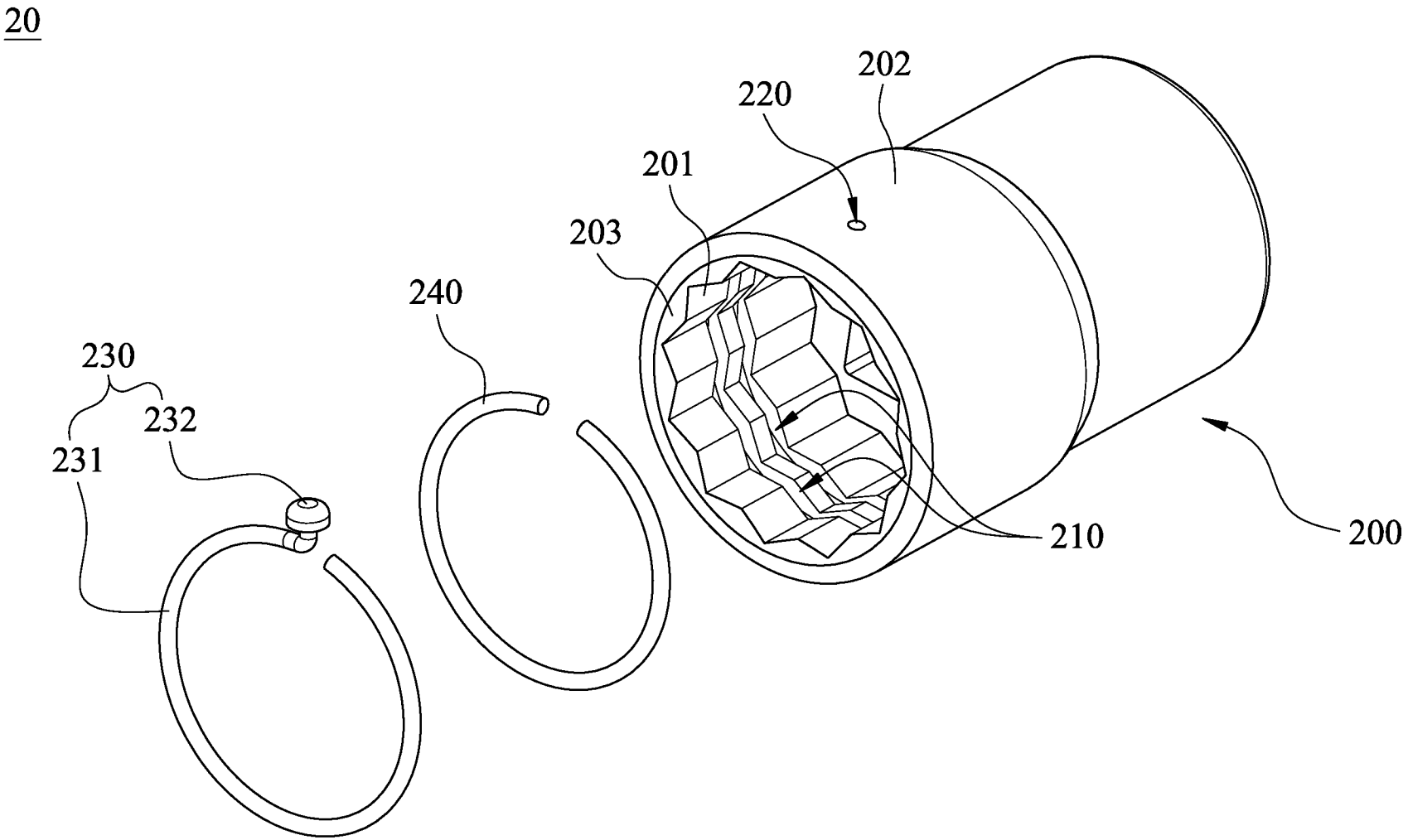
FIG. 3 is an exploded perspective view of the anti-rolling socket in FIG. 2.

Please refer to FIG. 2 and FIG. 3 respectively for a perspective view of the anti-rolling socket 20 according to the second embodiment of the present invention and an exploded perspective view of the anti-rolling socket 20 in FIG. 2. As shown in FIG. 2 and FIG. 3, the anti-rolling socket 20 includes a socket body 200, two grooves 210, a through hole 220, and a stopper 230. The socket body 200 has an inner peripheral surface 201, an outer peripheral surface 202, and an opening 203. The opening 203 is formed at one end of the socket body 200 so that a hand tool can be inserted into the socket body 200 through the opening 203. The two grooves 210 are disposed in, and along the circumference of, the inner peripheral surface 201 and are spaced apart. The through hole 220 is disposed between the inner peripheral surface 201 and the outer peripheral surface 202 and communicates with one of the grooves 210. The stopper 230 includes a stop ring 231 and a stop section 232. The stop ring 231 is fitted in the groove 210 that communicates with the through hole 220. The stop section 232 is connected to the stop ring 231, projects from the through hole 220, and protrudes from the outer peripheral surface 202.

One special feature of the second embodiment is that the anti-rolling socket 20 further includes a C-clip 240. The C-clip 240 is fitted in the groove 210 that does not communicate with the through hole 220. The C-clip 240 is made of an elastic material such as rubber, plastic, or metal; the present invention has no limitation in this regard. With both the stop ring 231 and the C-clip 240 engaged with the hand tool inserted in the socket body 200, the area of contact and engagement with the hand tool is increased as compared with when the C-clip 240 does not exist, and this helps increase the stability with which the hand tool can be operated. It is worth mentioning that a hand tool inevitably has dimensional errors within manufacturing tolerances, and that the dimensional errors may result in a mismatch in dimension when the hand tool is inserted into the socket, making the hand tool prone to falling off. The additional C-clip 240 of the anti-rolling socket 20 of the invention is intended to keep the hand tool effectively engaged in the socket body 200, thereby increasing the mechanical tolerance of the anti-rolling socket 20 and decreasing the difficulty of engagement attributable to dimensional errors of the hand tool.

Figure 4:
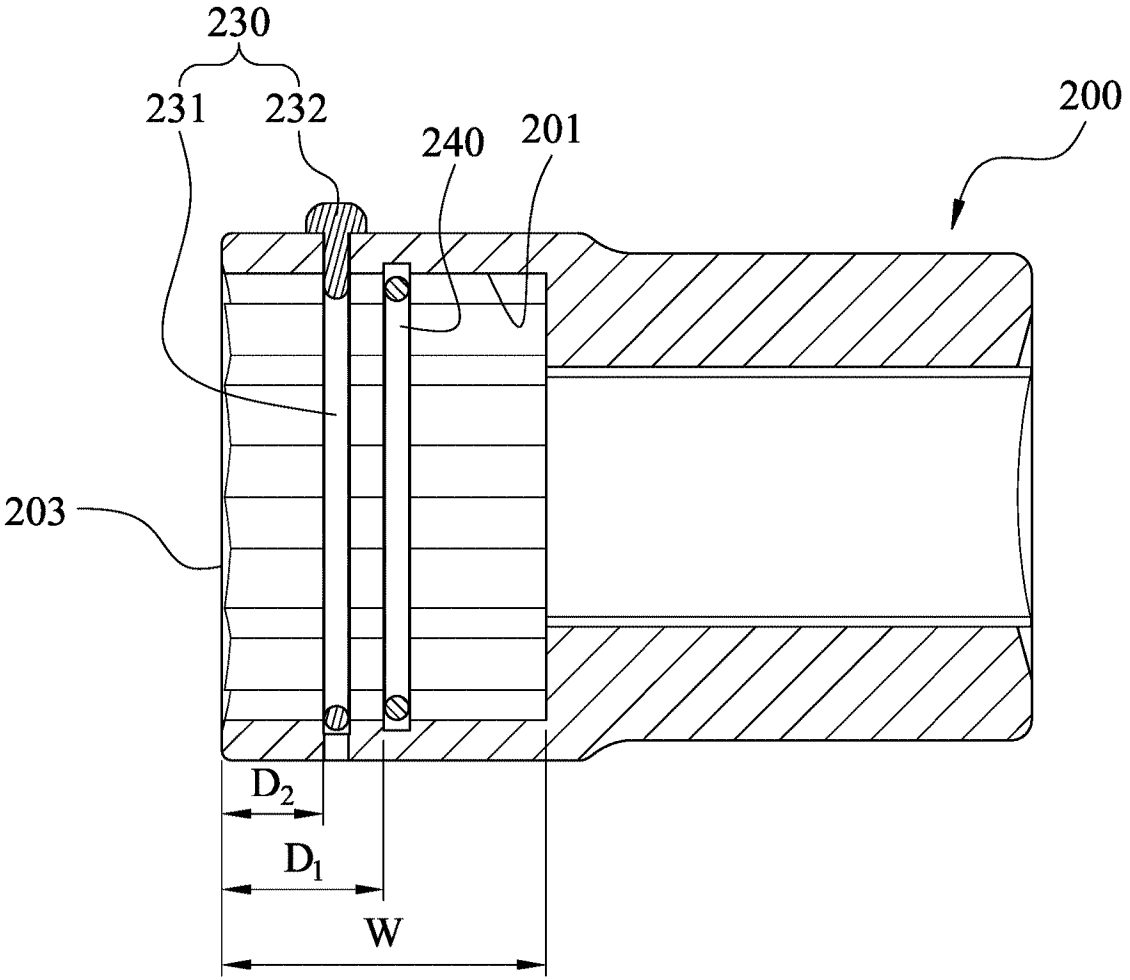
FIG. 4 is a sectional view of the anti-rolling socket in FIG. 2.

Please refer to FIG. 2 to FIG. 4, in which FIG. 4 is a sectional view of the anti-rolling socket 20 in FIG. 2. As shown in FIG. 4, the inner peripheral surface 201 of the socket body 200 has a width W, the distance from the C-clip 240 to the opening 203 is $D_1$, and the distance from the stop ring 231 to the opening 203 is $D_2$. The distance $D_1$ is one half of the width W, and the distance $D_2$ is less than the distance $D_1$. The distance $D_2$ may range from 1 mm to 6 mm but is not limited to this numerical range.

Figure 5:
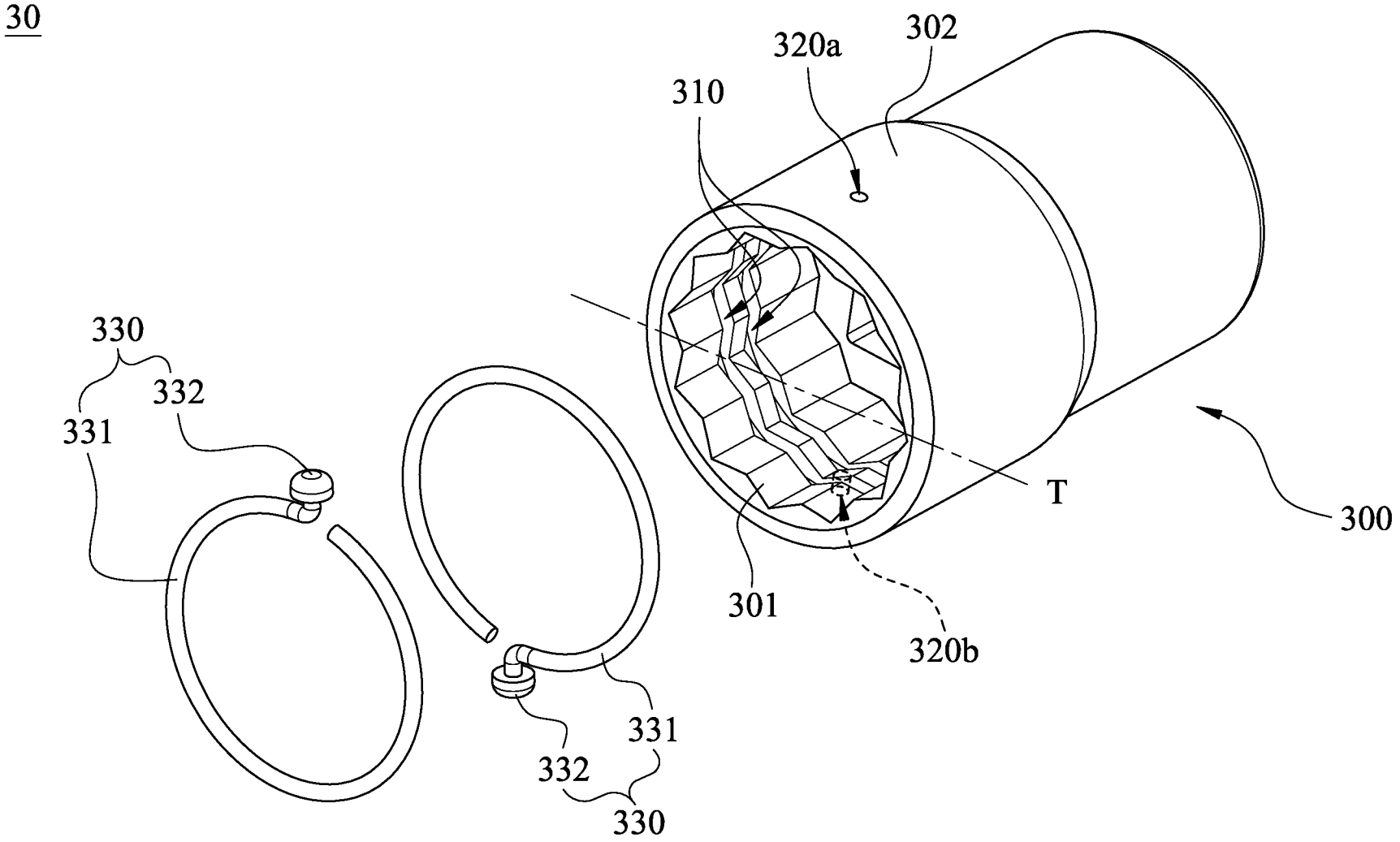
FIG. 5 is an exploded perspective view of the anti-rolling socket according to the third embodiment of the invention.

Please refer to FIG. 5 for an exploded perspective view of the anti-rolling socket 30 according to the third embodiment of the present invention. The stoppers 330 in the third embodiment have the same structure as the stopper 230 in the second embodiment and therefore will not be described repeatedly. As shown in FIG. 5, the anti-rolling socket 30 includes a socket body 300, two grooves 310, two through holes 320*a* and 320*b*, and two stoppers 330. The socket body 300 has an inner peripheral surface 301 and an outer peripheral surface 302. The two grooves 310 are disposed in, and along the circumference of, the inner peripheral surface 301 and are spaced apart. The stop rings 331 of the two stoppers 330 are disposed in the two grooves 310 respectively. Each through hole 320*a* or 320*b* is disposed between the inner peripheral surface 301 and the outer peripheral surface 302, and the two through holes 320*a* and 320*b* communicate with the two grooves 310 respectively. The stop rings 331 of the two stoppers 330 are fitted in the two grooves 310 respectively, with one of the stop sections 332 projecting from the through hole 320*a* and the other stop section 332 projecting from the through hole 320*b*.

It is worth noting that unlike the second embodiment, the third embodiment includes not only the through hole 320*a*, which is disposed in the outer peripheral surface 302, but also the through hole 320*b*, which is 180 degrees apart from the through hole 320*a* along the circular contour of the outer peripheral surface 302, with the two stop sections 332 located on two opposite sides of the sectional line T of the socket body 300 respectively. When the anti-rolling socket 30 is placed horizontally on a flat surface, therefore, both stop sections 332 serve to prevent the socket body 300 from rolling on the flat surface, and the distance for which the socket body 300 may roll until one of the stop sections 332 abuts against the flat surface will be less than the distance for which the socket body 200 in the second embodiment may roll until the only stop section 232 abuts against the flat surface.

Figure 6:
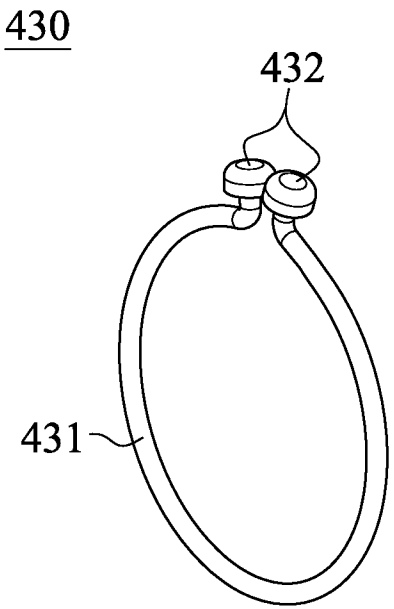
FIG. 6 is a perspective view of the stopper of the anti-rolling socket according to the fourth embodiment of the invention.

Please refer to FIG. 6 for a perspective view of the stopper 430 of the anti-rolling socket according to the fourth embodiment of the present invention. The socket body, the groove, and the through holes in the fourth embodiment have similar structures and a similar configuration relationship to the socket body 100, the groove 110, and the through hole 120 in the first embodiment and therefore will not be described repeatedly, the only difference being that the fourth embodiment includes two through holes instead of one. As shown in FIG. 6, the stopper 430 includes a stop ring 431 and two stop sections 432. The two stop sections 432 are located at two ends of the stop ring 431 respectively and lie against each other. When one of the stop sections 432 abuts against a flat surface, therefore, the reaction force applied by the flat surface to the stop section 432 abutting against the flat surface is reduced by this stop section 432 lying against the other stop section 432, and the chance of the former stop section 432 being broken by the reaction force is lowered.

Figure 7:
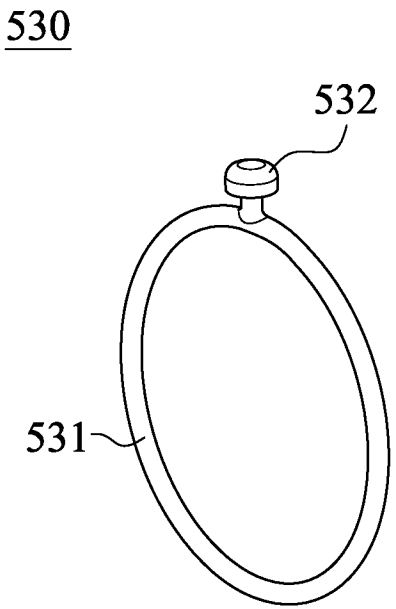
FIG. 7 is a perspective view of the stopper of the anti-rolling socket according to the fifth embodiment of the invention.

Please refer to FIG. 7 for a perspective view of the stopper 530 of the anti-rolling socket according to the fifth embodiment of the present invention. The socket body, the groove, and the through hole in the fifth embodiment have the same structures and configuration relationship as the socket body 100, the groove 110, and the through hole 120 in the first embodiment and therefore will not be described repeatedly. As shown in FIG. 7, the stopper 530 includes a stop ring 531 and a stop section 532, and the stop section 532 is disposed on the outer surface of the stop ring 531. Furthermore, the stop ring 531 is a closed stop ring. Compared with an open stop ring, the stop ring 531 has a simpler manufacturing process and can be fitted in the groove more securely.

Figure 8:
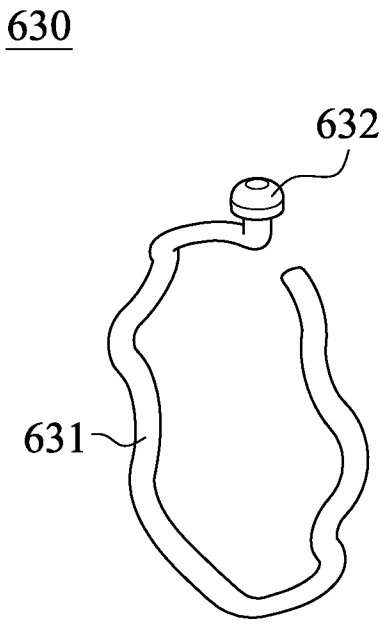
FIG. 8 is a perspective view of the stopper of the anti-rolling socket according to the sixth embodiment of the invention.

Please refer to FIG. 8 for a perspective view of the stopper 630 of the anti-rolling socket according to the sixth embodiment of the present invention. The socket body, the groove, and the through hole in the sixth embodiment have the same structures and configuration relationship as the socket body 100, the groove 110, and the through hole 120 in the first embodiment and therefore will not be described repeatedly. As shown in FIG. 8, the stopper 630 includes a stop ring 631 and a stop section 632, and the stop section 632 is connected to one end of the stop ring 631. Furthermore, the stop ring 631 has a wavy shape. The wavy configuration of the stop ring 631 helps reduce the chance of the stop ring 631 getting loose or falling off when subjected to an external force, alleviate the stress on the stop ring 631, and thereby extend the service life of the stop ring 631.

Figure 11:
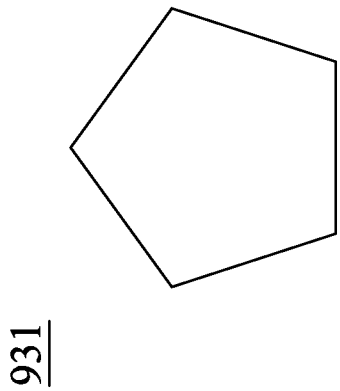
FIG. 11 is a sectional view of the stop ring of the anti-rolling socket according to the ninth embodiment of the invention.
Figure 10:
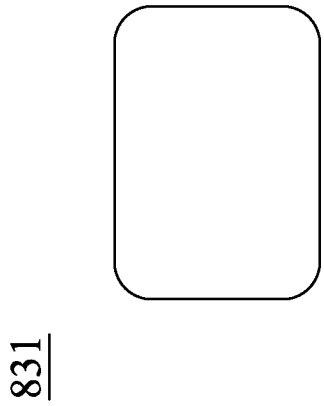
FIG. 10 is a sectional view of the stop ring of the anti-rolling socket according to the eighth embodiment of the invention.
Figure 9:
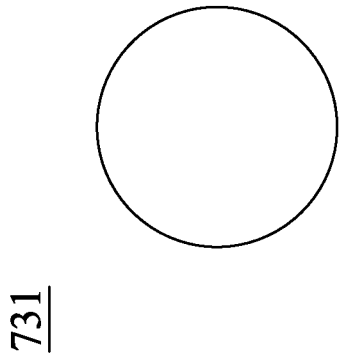
FIG. 9 is a sectional view of the stop ring of the anti-rolling socket according to the seventh embodiment of the invention.

Please refer to FIG. 9 for a sectional view of the stop ring 731 of the anti-rolling socket according to the seventh embodiment of the present invention, FIG. 10 for a sectional view of the stop ring 831 of the anti-rolling socket according to the eighth embodiment of the invention, and FIG. 11 for a sectional view of the stop ring 931 of the anti-rolling socket according to the ninth embodiment of the invention. The socket body, the groove, and the through hole in each of the seventh through the ninth embodiments have the same structures and configuration relationship as the socket body 100, the groove 110, and the through hole 120 in the first embodiment and therefore will not be described repeatedly. As shown in FIG. 9 to FIG. 11, the stop ring 731 has a circular cross section, the stop ring 831 has a round-corner polygonal cross section, and the stop ring 931 has a polygonal cross section. The invention, however, has no limitation on the cross-sectional shape of the stop ring and allows stop rings of different shapes to be provided for selection according to the structure of the hand tool to be used.

The numbers and structures of the stoppers and grooves of the anti-rolling sockets in the first to the ninth embodiments disclosed above may be combined as needed to meet the requirements of, and produce the desired engaging effects on, different hand tools.

According to the above, the present invention has the following advantages: 1) the at least one stop section can abut against a flat surface to prevent the socket body from rolling on the flat surface; 2) by disposing a plurality of stop sections respectively at different positions on the outer peripheral surface, the anti-rolling effect can be enhanced, and the distance for which the anti-rolling socket may roll after falling onto a flat surface will be reduced; and 3) the anti-rolling socket may provide stop rings of different shapes to enable selection according to the structure of the hand tool to be used.

While the present invention has been disclosed through the foregoing embodiments, those embodiments are not intended to be restrictive of the scope of the invention. A person skilled in the art shall be able to make various changes and modifications to the embodiments without departing from the spirit or scope of the invention. The scope of the patent protection sought by the applicant is defined by the appended claims.

What is claimed is:

1. An anti-rolling socket for a hand tool, comprising:

a socket body having an inner peripheral surface and an outer peripheral surface;

at least one groove disposed in, and along a circumference of, the inner peripheral surface;

at least one through hole disposed between the inner peripheral surface and the outer peripheral surface and communicating with the at least one groove; and at least one stopper comprising:

a stop ring fitted in the at least one groove; and at least one stop section connected to the stop ring, wherein the at least one stop section projects from the at least one through hole and protrudes from the outer peripheral surface and the stop ring in contact with the hand tool when the hand tool is inserted into the socket body.

2. The anti-rolling socket of claim 1, wherein the number of the at least one groove is two, the number of the at least one stopper is two, and the two stoppers are disposed in the two grooves respectively.

3. The anti-rolling socket of claim 1, wherein the number of the at least one groove is two, the number of the at least one stopper is one, the stopper is disposed in one of the grooves, and the anti-rolling socket further comprises:

a C-clip fitted in the other groove.

4. The anti-rolling socket of claim 1, wherein the number of the at least one through hole is plural, the number of the at least one stop section is plural, and the stop sections project from the through holes respectively.

5. The anti-rolling socket of claim 1, wherein the stop ring is of a wavy shape.

6. The anti-rolling socket of claim 1, wherein the stop ring has a polygonal cross section.

7. The anti-rolling socket of claim 1, wherein the stop ring is a closed stop ring.

8. The anti-rolling socket of claim 1, wherein the stop ring is an open stop ring.

9. The anti-rolling socket of claim 8, wherein the number of the at least one stop section is two, and the two stop sections are located at two ends of the stop ring respectively.

10. The anti-rolling socket of claim 8, wherein the stop ring has two ends, and the stop ring surrounds a central axis of the socket body in such a way that the two ends define a reflex central angle θ satisfying the condition: $270° \leq \downarrow \leq 360°$.

* * * * *